US006659308B1

(12) United States Patent
Kelder et al.

(10) Patent No.: US 6,659,308 B1
(45) Date of Patent: Dec. 9, 2003

(54) DISPENSING CLOSURES

(75) Inventors: Maria Louise Kelder, Hitchin (GB); Christopher Paul Ramsey, Wantage (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 39 days.

(21) Appl. No.: 10/030,627

(22) PCT Filed: Jul. 5, 2000

(86) PCT No.: PCT/GB00/02585

§ 371 (c)(1),
(2), (4) Date: May 20, 2002

(87) PCT Pub. No.: WO01/05674

PCT Pub. Date: Jan. 25, 2001

(30) Foreign Application Priority Data

Jul. 16, 1999 (GB) ..... 9916693

(51) Int. Cl.[7] ..... B65D 5/72
(52) U.S. Cl. ..... 222/83; 222/494
(58) Field of Search ..... 222/83, 494, 525, 222/563

(56) References Cited

U.S. PATENT DOCUMENTS 5,228,592 A * 7/1993 Pellerano ..... 222/83
5,853,109 A * 12/1998 Elliott ..... 222/83
6,045,004 A * 4/2000 Elliott ..... 222/83

FOREIGN PATENT DOCUMENTS

| | | | |
|---|---|---|---|
| EP | 0 296 100 B1 | | 4/1993 |
| EP | 0 473 678 B1 | | 11/1994 |
| GB | 1152931 | * | 5/1969 |

* cited by examiner

*Primary Examiner*—Philippe Derakshani
(74) *Attorney, Agent, or Firm*—Diller, Ramik & Wight

(57) ABSTRACT

A dispensing closure (18) for a container (10) of liquid product (70, 72) which is sealed by a piercable diaphragm (16). The closure includes a piercing member 924) which is moveable through a predetermined distance towards the container and which has a cutting edge arranged to pierce the diaphragm to form a dispensing aperture. At the end of its movement towards the interior of the container, the piercing member is arranged to plug the dispensing aperture against escape of the product when the container is inverted prior to dispensing. The closure is particularly useful for liquid products which tend to separate into a lighter (70) and heavier (72) fraction during storage. The closure prevents dripping of the lighter fraction when the container is inverted and allows the heavier fraction to displace the lighter fraction adjacent to the dispensing aperture before dispensing occurs.

12 Claims, 3 Drawing Sheets

DISPENSING CLOSURES

BACKGROUND OF THE INVENTION

This invention relates to dispensing closures for liquid products held in containers, particularly squeezable plastic bottles. The closure will usually have a hinged cover, although this is not essential to the present invention.

In the dispensing of some products from squeezable bottles, in particular tomato ketchups, difficulties arise with separation of the product into separate parts of respective lighter and heavier consistencies, and a tendency for the lighter consistency part to collect at the top of the product as a discrete layer.

With a tomato ketchup the lighter consistency part is a clear but red-tinted liquid known as "serum", and problems may arise when the user inverts the bottle prior to squeezing it for dispensing. Being of a relatively non-viscous nature, serum tends to spurt or drip from the closure before the more viscous ketchup can reach the dispensing aperture and close it off against further escape of product. To the consumer this premature escape of serum has been messy and annoying, with the result that the appeal of the ketchup as a consumer product has been reduced.

One object of the present invention is therefore to provide a closure capable of dispensing separating products such as tomato ketchup in a way which reduces or obviates any tendency for the lighter fraction of the product to leak from the closure prior to a normal dispensing operation.

In order to hermetically seal a bottle it is known to use a disc of plastics, paper and/or metal foil which is peripherally bonded, especially by heat or electrical induction, to the bottle neck rim to form a plane diaphragm closing the bottle mouth. The bond strength between the diaphragm and the bottle may then be such that it can be peeled away by the user after removal of the closure; alternatively the diaphragm may be permanently attached to the bottle and required to be pierced before product can be dispensed. The present invention relates to a closure for a container of the latter kind, that is to say, having its mouth closed by a piercable diaphragm.

Two earlier proposals for dispensers closures capable of piercing diaphragm closures on bottle mouths are described in EP 0296100 and EP 0473678. However, in each of these proposals the member which pierces the diaphragm to create the dispensing aperture is incapable of plugging the dispensing aperture, either because it is shaped to provide a free path for product flow, or because it is withdrawn resiliently from the diaphragm following the piercing operation. With each of these prior proposals there is therefore a danger that tomato ketchup serum will escape prior to dispensing.

GB 1152931 describes a closure with a piercing member which pierces a diaphragm and plugs the dispensing aperture. However, the member is completely removed from the aperture together with the rest of the closure before product can escape from the unplugged aperture.

SUMMARY OF THE INVENTION

In accordance with the invention from a first aspect there is provided a dispensing closure for a liquid product container having an opening closed by a piercable diaphragm, the closure having a piercing member with a cutting edge, which is moveable through a predetermined distance and is adapted to pierce the diaphragm during such movement to form a severed edge which defines a dispensing aperture, at the end of its movement the piercing member is arranged to plug the dispensing aperture against escape of product, characterised in that, at the end of its movement the piercing member is maintained in contact with the severed edge to plug the dispensing aperture, and in that when the container is inverted the piercing member is held in its depressed position, product may be subsequently dispensed from the container through the dispensing aperture by generating an increased product pressure in the container, which lifts the severed edge away from at least part of the piercing member, thereby opening the dispensing aperture.

According to a preferred feature of the invention the movable member is located and movable within a dispensing spout or nozzle by which product being dispensed may leave the closure. Desirably the spout and movable member are laterally offset in relation to the closure, so that they can be located adjacent the bottom of the closure when the associated container is downwardly tilted for dispensing.

In order that the invention may be more fully understood embodiments thereof will now be described, by way of example only and with reference to the accompanying drawings. In the drawings:

DESCRIPTION OF THE PREFERRED EMBODIMENTS

Figure 1:
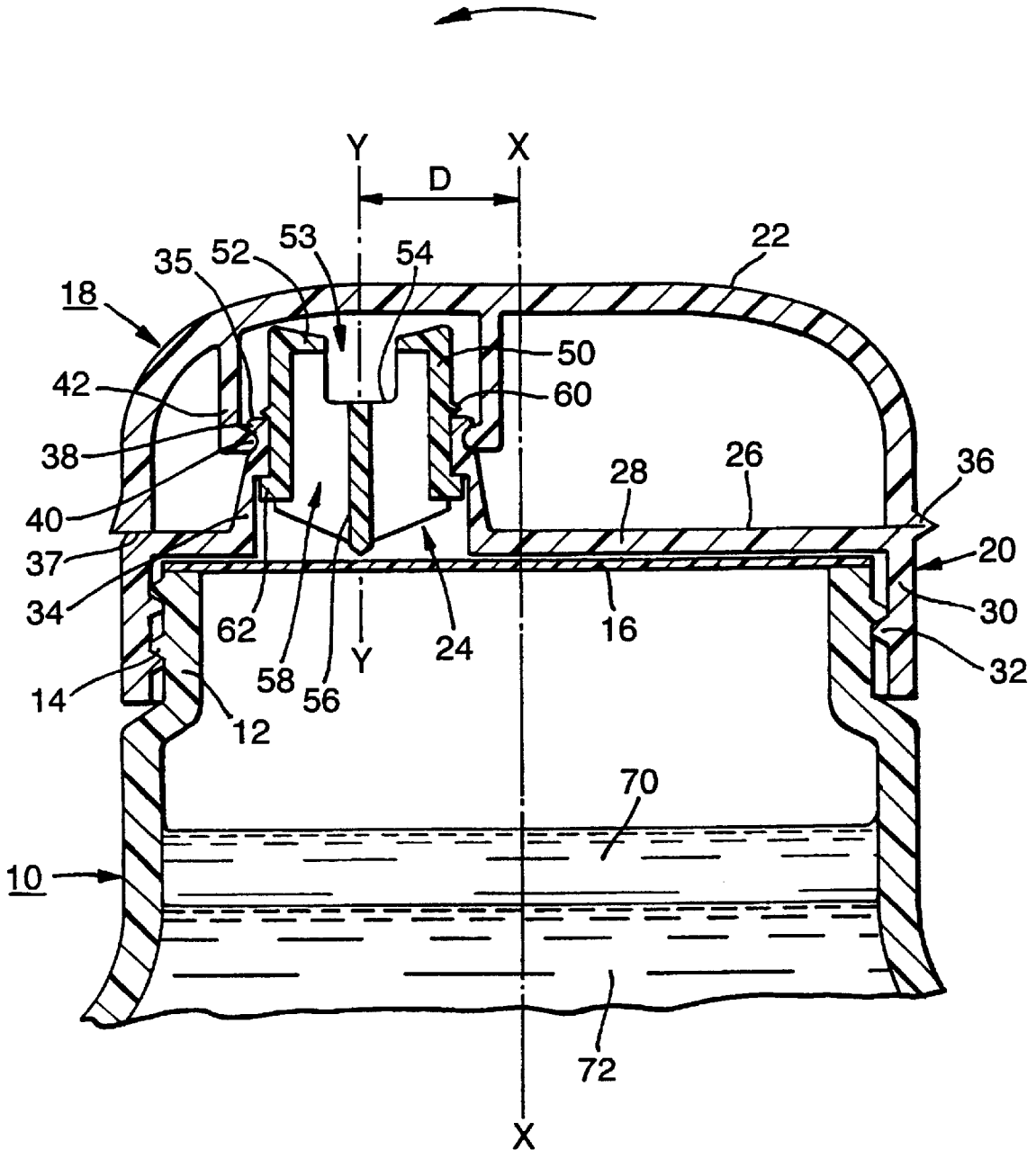
FIG. 1 shows a first closure in accordance with the invention when fitted to the neck of a squeeze bottle of a tomato ketchup which is closed by a closure diaphragm.

Referring now to FIG. 1, a squeeze bottle 10 formed from a thermoplastics material having a low oxygen permeability, e.g. of multilayer construction, has a reduced diameter neck 12 formed externally with screw threads 14. The bottle holds a tomato ketchup product 70,72, and is sealed hermetically closed by a plane closure diaphragm formed by a disc 16 which is peripherally sealed to the free edge or rim of the neck 12.

The disc 16 is arranged to present a high barrier to oxygen permeation into the bottle, and for that purpose it is of multilayer construction one layer of which is formed of metal foil. For clarity the layers of the disc are not separately shown. Conveniently, and in known manner, the disc is heat-sealed to the bottle by electrical induction using the metal foil layer as the electrical heating medium in which eddy currents are generated. Conveniently also, and again in known manner, the disc is initially incorporated into, and applied with, the closure, and is transferred to the bottle by the induction-sealing operation.

A screw closure 18 embodying the invention is fitted onto the bottle neck 12 to form a package for retail sale. It has two unitary parts, namely a body 20 with domed cover 22, and a piercing member 24 which is mounted and movable in relation to the body as will be described.

The body 20 has a circular lower portion 26 with a transverse and generally plane closure panel 28 overlying the disc 16, and a depending peripheral skirt 30. The skirt has internal screw threads 32 which are engaged beneath the bottle screw threads 14 to attach the closure to the bottle. If desired, overriding formations (not shown) may be provided on the closure and bottle to prevent closure removal once it has been fitted.

A hollow vertical chimney 34 projects upwardly from the closure panel 28 to provide a dispensing spout for the closure. For that purpose it has a pouring lip 35 at its free upper end. The chimney is offset laterally by distance D in relation to the centreline XX of the closure and bottle, so that when the bottle is rotated by the consumer through approximately 145° in the anticlockwise direction as shown, the chimney is located adjacent what has become the bottom of the closure, and product can be conveniently and accurately dispensed by squeezing the bottle.

The cover 22 is integrally attached to the lower portion 26 of the body by a hinge 36, at a position which is diametrically opposed to the chimney 34. The hinge may take many forms, and may be a snap-action hinge if desired. FIG. 1 shows the cover in its closed position, in which the free edge 37 of the cover abuts the upper surface of the closure panel 28 around the periphery of the closure. Further engagement between the cover and the lower portion 26 occurs at the exterior of the chimney 34, where a bead 38 formed around the free end of the chimney is engaged by a complementary internal bead 40 formed at the free end of a collar 42 which depends from the underside of the cover. The beads 38, 40 are snap-engaged with one another to hold the cover releasably and resiliently closed as shown.

The piercing member 24 is mounted within the chimney 34 for sliding movement parallel to the closure/bottle axis XX, that is to say, vertically as shown in the drawings. As can be seen from FIGS. 1 and 2 in combination, the piercing member has an external, generally cylindrical, shell 50 which is partially closed at its top end by an inturned flange 52 defining a central opening 53. Within and moulded integrally with the shell, and extending for some distance below its bottom edge, is a cruciform core 54 formed of two mutually orthogonal, plane webs 56 and 58 of which the web 56 is the longer. The webs are longitudinally and axially directed in relation to the shell 50, and they intersect one another on the centreline YY of the piercing member.

FIG. 1 shows the piercing member 24 as it appears when the package is retailed to the consumer. It is then held in an elevated position with its lower end located just out of contact with the disc 16 beneath. This position is achieved by engagement of a small peripheral bead 60 on the shell 50 with the pouring lip 35 of the chimney 34. A flange 62 formed around the bottom of the shell engages a downwardly facing shoulder (unreferenced) within the chimney interior so that the piercing member is held securely in this elevated position up to the point of first use. The cover 22 provides protection against inadvertent operation of the piercing member during this time.

For dispensing ketchup from the bottle 10 the user is required to swing the cover 22 open on its hinge 36, so providing access to the piercing member 24 beneath. At this time the bottle may be upright, and supported from a horizontal surface.

Thumb pressure applied by the user on top of the piercing member 24-(which may be shaped, as shown, for user comfort)—then overrides the resistance provided by the bead 60, and drives the piercing member sharply downwards against the disc 16 guided by sliding engagement within the chimney 34.

Providing sufficient force is applied to the piercing member, the web 56 is able to sever the material of the disc 16 to form a dispensing aperture which substantially corresponds in shape to the cross-section of the web.

The downward movement of the piercing member is terminated when its flange 52 becomes flush with the pouring lip 35 of the chimney 34 so that no further thumb pressure can be applied. At the same time the bead 60 becomes snap-engaged beneath the shoulder of the chimney 34 to hold the piercing member permanently in its depressed position.

In the depressed position of the piercing member the bottom edge of its shorter web 58 engages the top surface of the disc 16 on either side of the dispensing aperture, without severing the disc material. The web 58 thereby provides local support for the disc material for any following dispensing operation, as will be described.

After the piercing member has been operated in this way, and with the cover still open, the bottle is ready for dispensing product. For this, the consumer tips the bottle through about 145° in the anticlockwise direction as shown in FIG. 1, and thereafter squeezes the bottle to dispense ketchup in the normal way and as required.

Unless the bottle has been vigorously shaken immediately beforehand, a layer 70 (FIG. 1) of serum may lie on top of the ketchup 72 proper, after separation from the ketchup, and there is a danger that serum from this layer, being of a relatively low viscocity, will spurt or drip prematurely from the closure as the bottle is being upended. However, the piercing member 24 is held in its depressed position by the bead 60, and so forms a plug by which the dispensing aperture in the disc is closed. In this respect it should be mentioned that the dispensing aperture, having been formed by the web 56, is closely conformed to it so that the engagement between its own severed edge and the side surfaces of the web can result in a substantially perfect seal against escape of serum.

As tipping of the bottle proceeds prior to dispensing, the ketchup fraction of the product flows down the bottle and is eventually able to displace the serum upwards past the entrance to the dispensing aperture. Some mixing of the serum with the ketchup may occur at this time.

Figure 2:
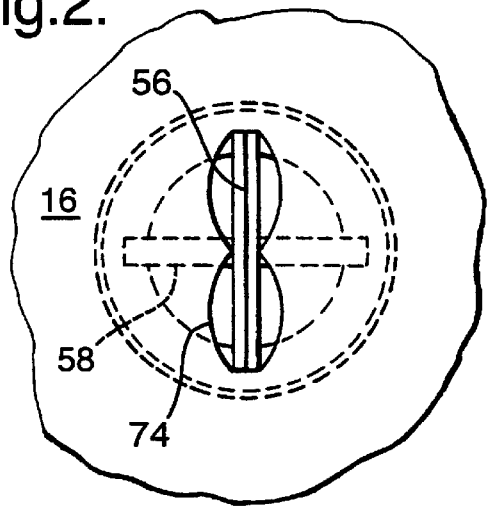
FIG. 2 is a view, seen from the interior of the squeeze bottle, of the closure diaphragm after it has been punctured by the closure of FIG. 1.

When, subsequently, the bottle is squeezed, increased pressure which is created in the ketchup distends the dispensing aperture so that the defining severed edge of the disc 16 is lifted at least partially away from the web 56 of the piercing member 24 to create one or more paths through which ketchup, possibly with admixed serum, can pass for dispensing. Thus the piercing member creates the dispensing aperture in the disc and plugs it against serum escape while the bottle is being upended prior to dispensing, elevated pressure created in the ketchup thereafter causing the dispensing aperture to become enlarged to allow dispensing The deformation of the disc 16 in the locality of the dispensing aperture which accompanies dispensing is illustrated in FIG. 2, where the severed edge which defines the dispensing aperture is denoted 74. It will be seen that the severed edge moves away friom the web 56 at four lobes each of which forms a flow path for ketchup to pass. The lobes are dispensed in pairs, two on each side of the web 56. The lobes of each pair are separated from one another by substantially undistended material of the disc 16 where support is provided by the shorter web 58. In a modification the web 58 is relieved from any engagement with the disc, in which case two generally chordal flow paths are formed, one on each side of the web 56—see FIG. 3.

Figure 4:
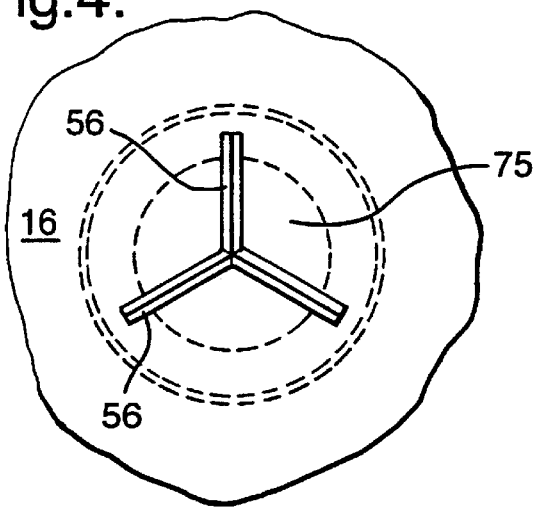
FIG. 4 is a similar view relating to another modification of the closure after the diaphragm has been punctured by the closure.
Figure 5:
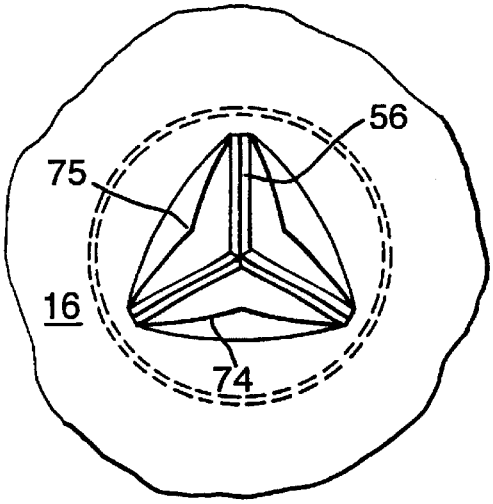
FIG. 5 is a view of the closure of FIG. 4, when the internal pressure in the container is raised.

FIGS. 4 and 5 show an alternative embodiment of the piercing member 24. In this embodiment, the piercing member comprises a plurality of cutting webs 56. The cutting webs 56 cut the disc 16 in such a way as to produce a number of flaps 75. The Applicants have found that a triangular arrangement of three cutting webs (as shown in FIGS. 4 and 5) is the most effective arrangement to ensure penetration of all the cutting webs 56 through the disc 16. The dispensing aperture, formed by the webs 56, again closely conforms to the webs and the engagement between the severed edge of the disc 16 and the side surfaces of the webs 56 ensure that serum cannot escape.

When a user squeezes the container to dispense the product, the flaps 75 fold away from the webs 56 to provide a large dispensing passageway (as shown in FIG. 4). This arrangement allows a larger flow of product to be dispensed from the container, which is particularly useful for very viscous products.

Figure 6:
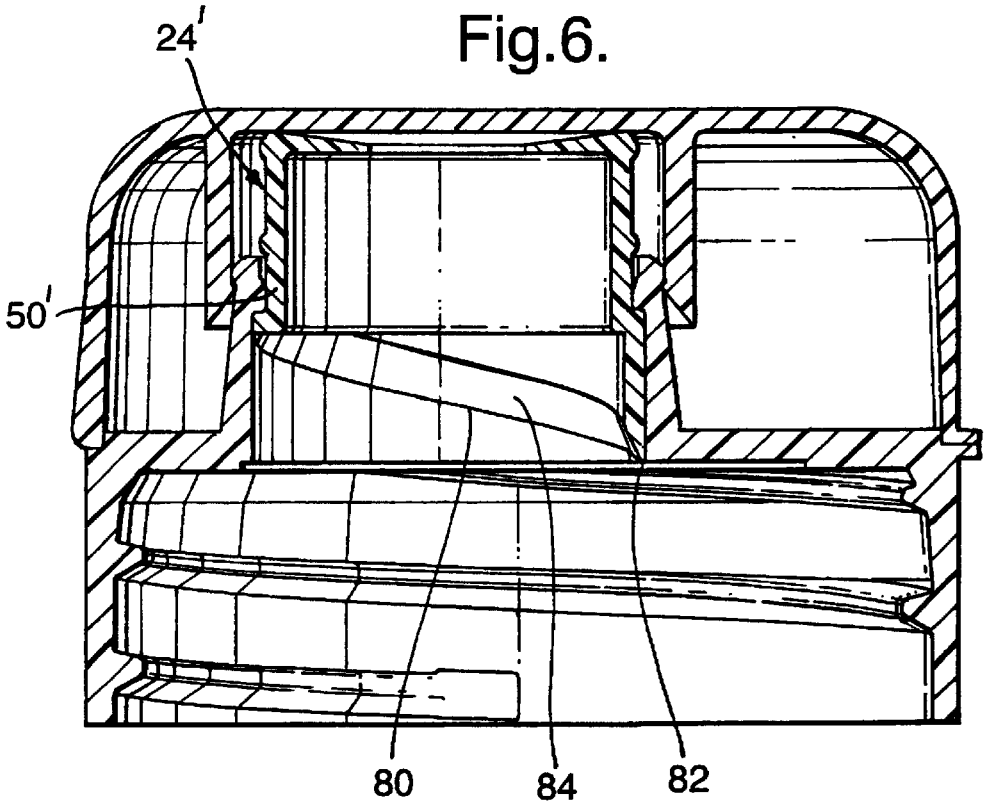
FIG. 6 shows a second closure in accordance with the invention before fitting to a squeeze bottle.

FIG. 6 shows a further closure in accordance with the invention, which is similar to that of the first embodiment in many respects. In this embodiment the piercing member 24' has no central core. Instead, its cylindrical shell 50' is extended downwardly over one half of its circumference to provide a half-circular cutting edge 80 with a lead point 82 and inclined cutting flank 84.

Figure 3:
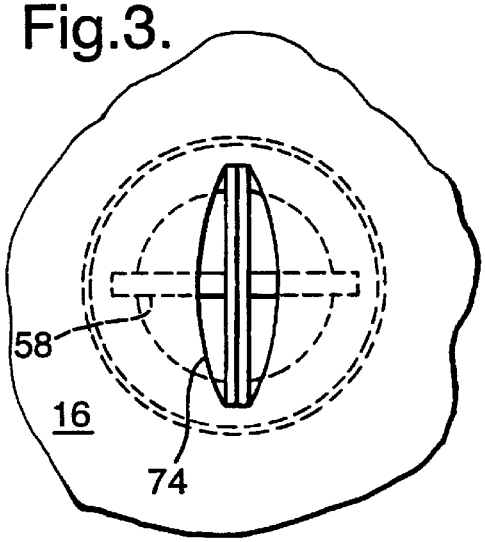
FIG. 3 is a similar view relating to a modification of the closure.
Figure 7:
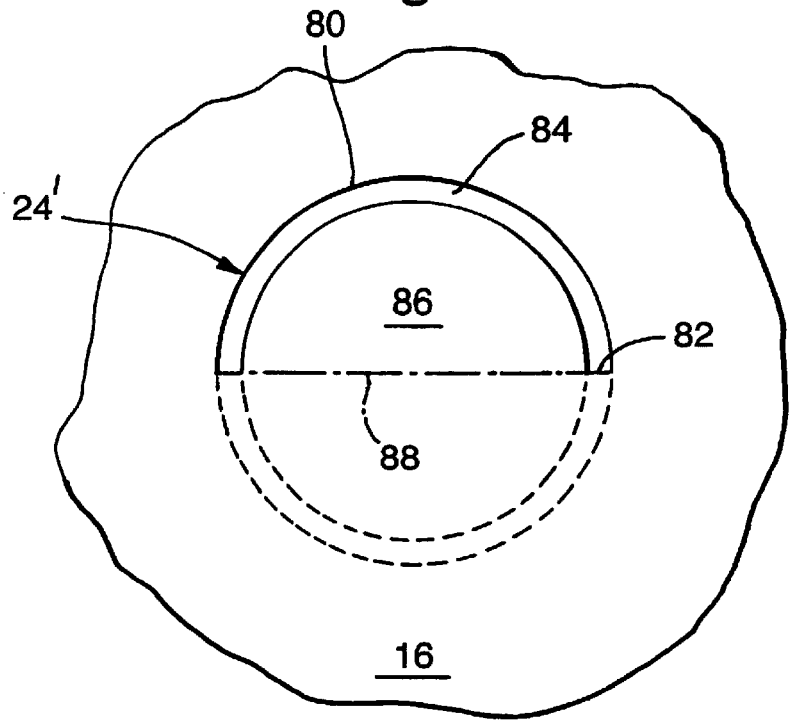
FIG. 7 is a view corresponding to FIGS. 2, 3 and 5, in relation to the second closure.

FIG. 7 is a view similar to FIGS. 2 and 3 and showing the dispensing aperture which is formed by the piercing member 24' in the sealing disc 16 of the bottle beneath. It will be seen that the part of the severed edge which is formed within the hollow of the piercing member defines a part-circular tab 86. This tab has a substantial freedom to flex about the diametral line 88 by which it is attached to the remainder of the disc. Such an arrangement is particularly valuable for very high viscocity products to reduce the effort required from the consumer for dispensing.

From FIGS. 2, 3, 4, 5 and 7 in particular it will be understood that by suitable choice of the shape of the piercing member and therefore of the dispensing aperture which it forms in the sealing membrane, the performance of the closure to prevent premature escape of the lighter fraction of a product subject to separation whilst subsequently allowing dispensing when the container is pressurised can be closely controlled. Amongst the other variables which can be used for this purpose are, for example, the thickness of the piercing member where it penetrates the sealing diaphragm, and the thickness and flexural rigidity of the diaphragm material. In addition, it may be preferred for the piercing member to have a particular angular orientation and position in relation to the diaphragm.

Many modifications and variations of the described closures are possible within the scope of the invention. Thus, whilst the closures shown in the drawings have their piercing members moulded separately and disposed within the dispensing outlet of the closure, it is possible for them to be moulded integrally with the closure (but movable in relation to it) and/or for them to be offset in relation to the dispensing outlet.

Piercing members which are moulded separately from the closure body may allow a polymer to be used which is different from that of the closure body; for example, a hard polymer capable of providing a keen cutting edge may be used for applications where the closure diaphragm is made from an especially tough and cut-resistant material.

Although a preferred embodiment of the invention has been specifically illustrated and described herein, it is to be understood that minor variations may be made in the apparatus without departing from the spirit and scope of the invention, as defined the appended claims.

What is claimed is:

1. A dispensing closure (18) for a liquid product container (10) having an opening closed by a piercable diaphragm (16), the closure having a piercing member (24) with a cutting edge, which is moveable through a predetermined distance and is adapted to pierce the diaphragm during such movement to form a severed edge which defines a dispensing aperture, at the end of its movement the piercing member is arranged to plug the dispensing aperture against escape of product, characterised in that, at the end of its movement the piercing member is maintained in contact with the severed edge to plug the dispensing aperture, and in that when the container is inverted the piercing member is held in its depressed position, product may be subsequently dispensed from the container through the dispensing aperture by generating an increased product pressure in the container, which lifts the severed edge away from at least part of the piercing member, thereby opening the dispensing aperture.

2. The dispensing closure (18) as defined in claim 1 and further comprising a dispensing spout (34) by which the product is dispensed through the closure, the piercing member (24) being located and moveable within the dispensing spout.

3. The dispensing closure (18) as defined in claim 2, wherein the dispensing spout (34) and piercing member (24) are laterally offset from the central axis of the closure.

4. The dispensing closure (18) as defined in claim 1 wherein the piercing member has a central core, comprising at least one web (56) having a cutting edge.

5. The dispensing closure 18 as defined in claim 4 wherein the central core of the piercing member (24) comprises a plurality of webs (56) having a cutting edge, the webs arranged to pierce the diaphragm (16) to produce a plurality of flaps (75).

6. The dispensing closure (18) as defined in claim 4 wherein the central core of the piercing member comprises three webs (56) having a cutting edge, the webs arranged to extend radially outwardly from the central longitudinal axis of the piercing member (16).

7. The dispensing closure (18) as defined in claim 4 wherein the piercing member (24) further comprises at least one support web (58) arranged to engage the diaphragm (16) without piercing it.

8. The dispensing closure (18) as defined in claim 2 wherein the piercing member (24') comprises a tubular shell (50') arranged to move telescopically within the dispensing spout, the tubular shell having a cutting edge (80) around at least part of its periphery.

9. The dispensing closure (18) as defined in claim 5 wherein the central core of the piercing member comprises three webs (56) having a cutting edge, the webs arranged to extend radially outwardly from the central longitudinal axis of the piercing member (16).

10. The dispensing closure (18) as defined in claim 5 wherein the piercing member (24) further comprises at least one support web (58) arranged to engage the diaphragm (16) without piercing it.

11. The dispensing closure (18) as defined in claim 6 wherein the piercing member (24) further comprises at least one support web (58) arranged to engage the diaphragm (16) without piercing it.

12. The dispensing closure (18) as defined in claim 3 wherein the piercing member (24') comprises a tubular shell (50') arranged to move telescopically within the dispensing spout, the tubular shell having a cutting edge (80) around at least part of its periphery.

* * * * *